US005460011A

United States Patent [19]

Martin

[11] Patent Number: 5,460,011

[45] **Date of Patent: * Oct. 24, 1995**

[54] REFRIGERATOR SYSTEM, A CONTROL DEVICE THEREFOR AND METHODS OF MAKING THE SAME

[75] Inventor: David D. Martin, Dunbar, Pa.

[73] Assignee: Robertshaw Controls Company, Richmond, Va.

[ * ] Notice: The portion of the term of this patent subsequent to Nov. 8, 2011 has been disclaimed.

[21] Appl. No.: 306,161

[22] Filed: Sep. 14, 1994

Related U.S. Application Data

[62] Division of Ser. No. 122,681, Sep. 17, 1993, Pat. No. 5,361,596.

[51] Int. Cl.[6] ..... F25D 17/06

[52] U.S. Cl. ..... 62/187

[58] Field of Search ..... 62/187; 49/388, 49/397; 16/378, 379, 298; 137/527.8; 251/303

[56] References Cited

U.S. PATENT DOCUMENTS

| | | | |
|---|---|---|---|
| 1,869,258 | 7/1932 | Holland | 137/527.8 X |
| 3,455,059 | 7/1969 | Evans, III | 49/397 |
| 4,099,511 | 7/1978 | McIntire et al. | 49/397 X |
| 4,478,005 | 10/1984 | Mundschenk | 49/397 X |
| 5,144,813 | 9/1992 | Orner et al. | 62/187 |
| 5,361,596 | 11/1994 | Martin | 62/187 |

*Primary Examiner*—William E. Tapolcai

*Attorney, Agent, or Firm*—Fulbright & Jaworski

[57] ABSTRACT

A refrigerator system, a control device therefor and methods of making the same are provided, the control device comprising a housing having a valve seat and a movable valve member being adapted to open and close the valve seat, the housing having a substantially straight angled edge and the valve member having an end edge that is adapted to pivot on the angled edge, the end edge of the valve member comprising a pair of pivot parts respectively disposed at the opposite ends of the end edge thereof in spaced apart relation and being the only parts of the end edge thereof that engage the angled edge of the housing to pivot thereon.

10 Claims, 3 Drawing Sheets

REFRIGERATOR SYSTEM, A CONTROL DEVICE THEREFOR AND METHODS OF MAKING THE SAME

CROSS REFERENCE TO RELATED APPLICATIONS

This application is a divisional patent application of its parent patent application, Ser. No. 122,681, filed Sep. 17, 1993, now U.S. Pat. No. 5,361,596.

BACKGROUND OF THE INVENTION

1. Field of the Invention

This invention relates to a new control device and to a new refrigerator system utilizing the new control device as well as to a new method of making such a control device and to a new method of making such a refrigerator system.

2. Prior Art Statement

It is known to provide a control device for a refrigerator system having a frozen food compartment and a nonfrozen food compartment interconnected together by an air circulating means that is adapted to direct an air flow from the frozen food compartment to the nonfrozen food compartment when a valve member of the control device is in an open condition thereof, the control device comprising a housing means having a valve seat means and having an inlet means for interconnecting to the frozen food compartment and an outlet means for interconnecting to the nonfrozen food compartment, the valve seat means interconnecting the inlet means and the outlet means together, a movable valve member carried by the housing means and being adapted to open and close the valve seat means by being respectively moved to an open position thereof and a closed position thereof, and actuator means carried by the housing means and being operatively interconnected to the valve member to move the valve member between the positions thereof, the housing means having a substantially straight angled edge means, the valve member having an end edge means that is adapted to pivot on the angled edge means, the end edge means having opposite end means thereof and being substantially straight between those opposite end means. For example, see the Orner et al, U.S. Pat. No. 5,144,813.

SUMMARY OF THE INVENTION

It is one of the features of this invention to provide a new hinging arrangement for the valve member that pivots on the housing means of a refrigerator control device or the like to open and close a valve seat means of the housing means.

In particular, it was found that the prior known hinging arrangement had a substantially straight end edge means on the valve member that provided a sliding pivot action on a substantially straight angled edge means of the housing means that resulted in an adverse rocking motion therebetween.

However, it was found according to the teachings of this invention that the valve member can be provided with a pair of pivot parts respectively disposed at the opposite end means of the end edge means thereof in spaced apart relation and be the only parts of the end edge means of the valve member that engage the angled edge means of the housing means to pivot thereon and thereby provide for a smoother operating motion of the valve member relative to the housing means during the opening and closing thereof.

For example, one embodiment of this invention provides a control device for a refrigerator system having a frozen food compartment and a nonfrozen food compartment interconnected together by an air circulating means that is adapted to direct an air flow from the frozen food compartment to the nonfrozen food compartment when a valve member of the control device is in an open condition thereof, the control device comprising a housing means having a valve seat means and having an inlet means for interconnecting to the frozen food compartment and an outlet means for interconnecting to the nonfrozen food compartment, the valve seat means interconnecting the inlet means and the outlet means together, a movable valve member carried by the housing means and being adapted to open and close the valve seat means by being respectively moved to an open position thereof and a closed position thereof, and actuator means carried by the housing means and being operatively interconnected to the valve member to move the valve member between the positions thereof, the housing means having a substantially straight angled edge means, the valve member having an end edge means that is adapted to pivot on the angled edge means, the end edge means having opposite end means thereof, the end edge means of the valve member comprising a pair of pivot parts respectively disposed at the opposite end means thereof in spaced apart relation and being the only parts of the end edge means that engage the angled edge means of the housing means to pivot thereon.

Accordingly, it is an object of this invention to provide a new control device having one or more of the novel features of this invention as set forth above or hereinafter shown or described.

Another object of this invention is to provide a new method of making such a control device, the method of this invention having one or more of the novel features of this invention as set forth above or hereinafter shown or described.

Another object of this invention is to provide a new refrigerator system utilizing such a new control device, the refrigerator system of this invention having one or more of the novel features of this invention as set forth above or hereinafter shown or described.

Another object of this invention is to provide a new method of making such a refrigerator system, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
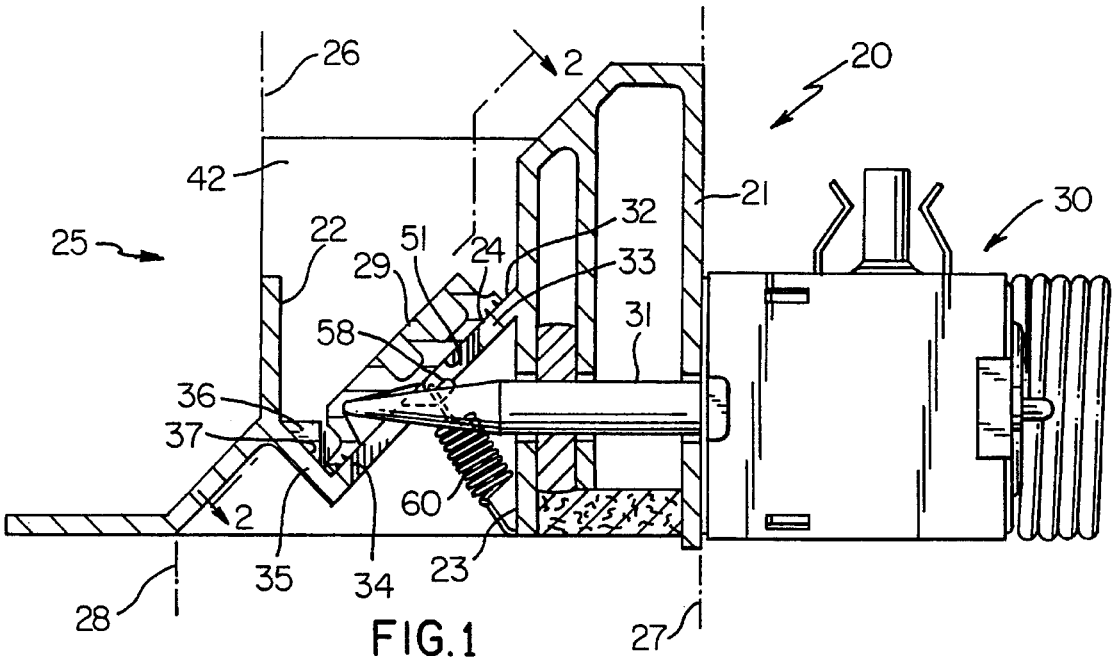
FIG. 1 is a side view that is partially in cross section and illustrates the new control device of this invention being utilized in a refrigerator system of this invention that is also schematically illustrated in FIG. 1.
Figure 2:
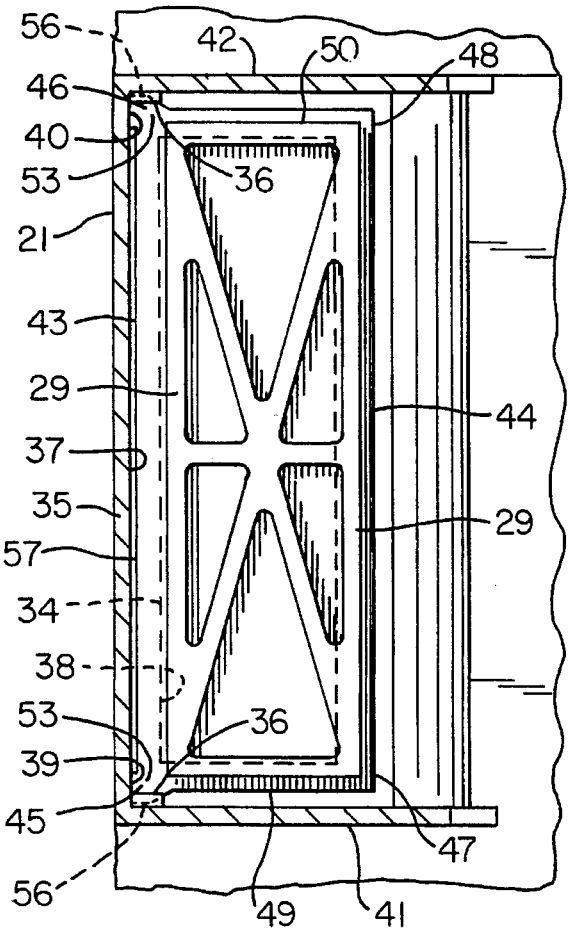
FIG. 2 is a fragmentary cross-sectional view taken on line 2—2 of FIG. 1.
Figure 3:
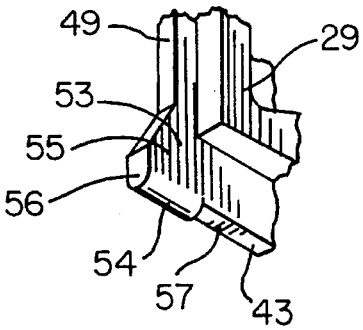
FIG. 3 is an enlarged fragmentary perspective view of one of the end means of the valve member of the control device of FIGS. 1 and 2.

While the various features of this invention are hereinafter illustrated and described as being particularly adapted to provide a control device for a refrigerator system, it is to be understood that the various features of this invention can be utilized singly or in various combinations thereof to provide a control device for other types of systems as desired.

Therefore, this invention is not to be limited to only the embodiment illustrated in the drawings, because the drawings are merely utilized to illustrate one of the wide variety of uses of this invention.

Figure 4:
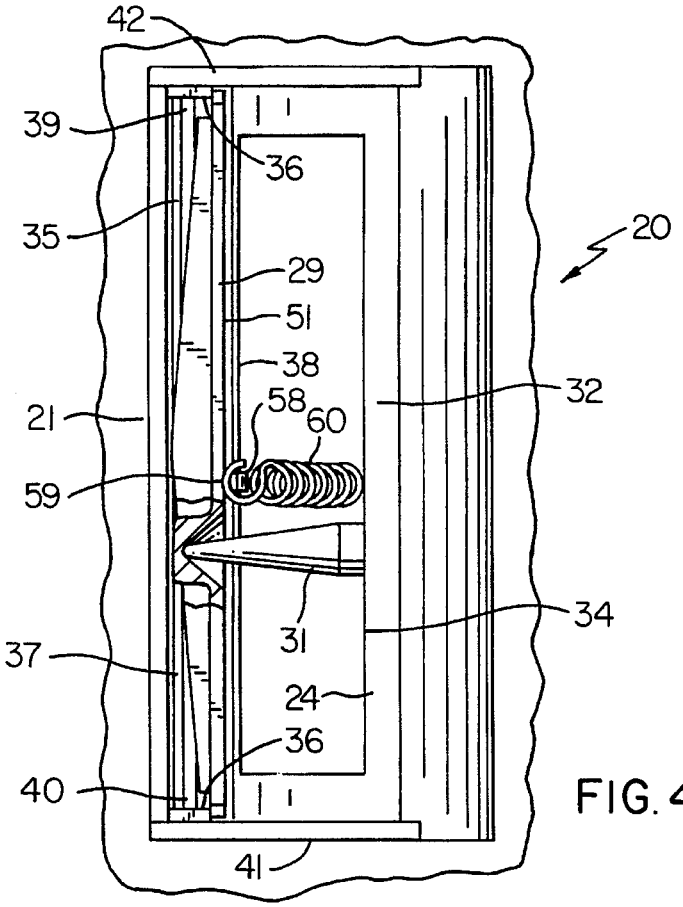
FIG. 4 is a view similar to FIG. 2 and illustrates the valve member in the fully open position thereof.
Figure 5:
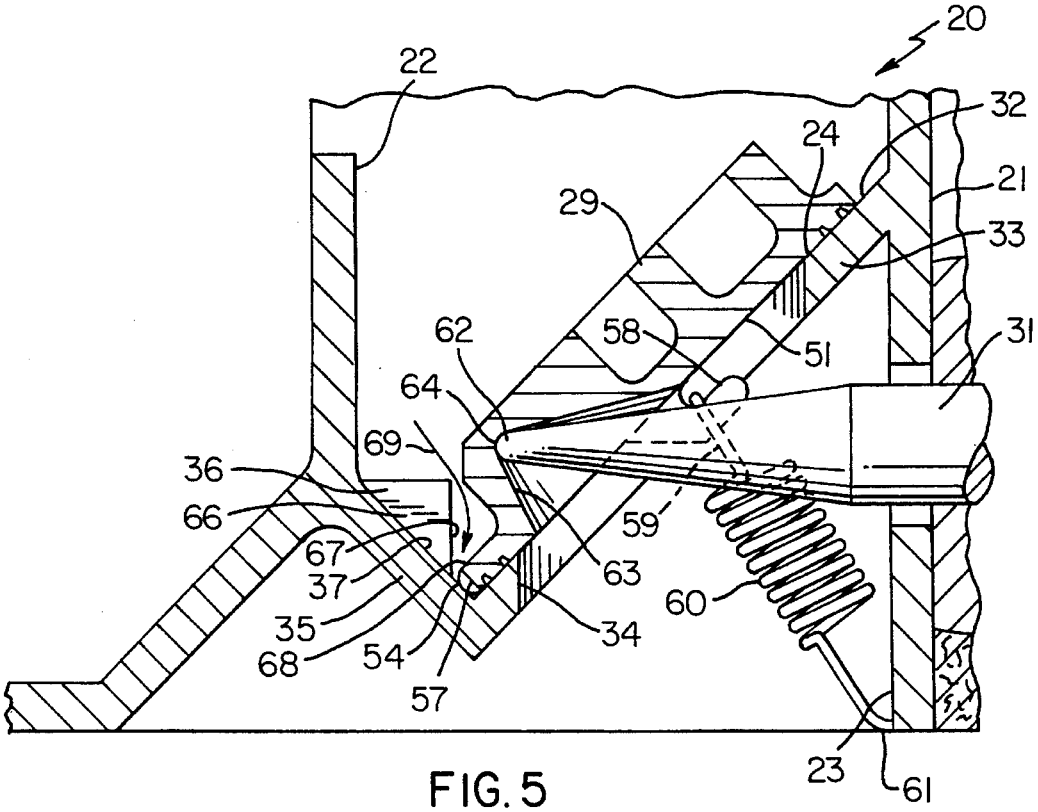
FIG. 5 is an enlarged fragmentary view of part of the control device illustrated in FIG. 1 and illustrates the valve member in its closed position.
Figure 6:
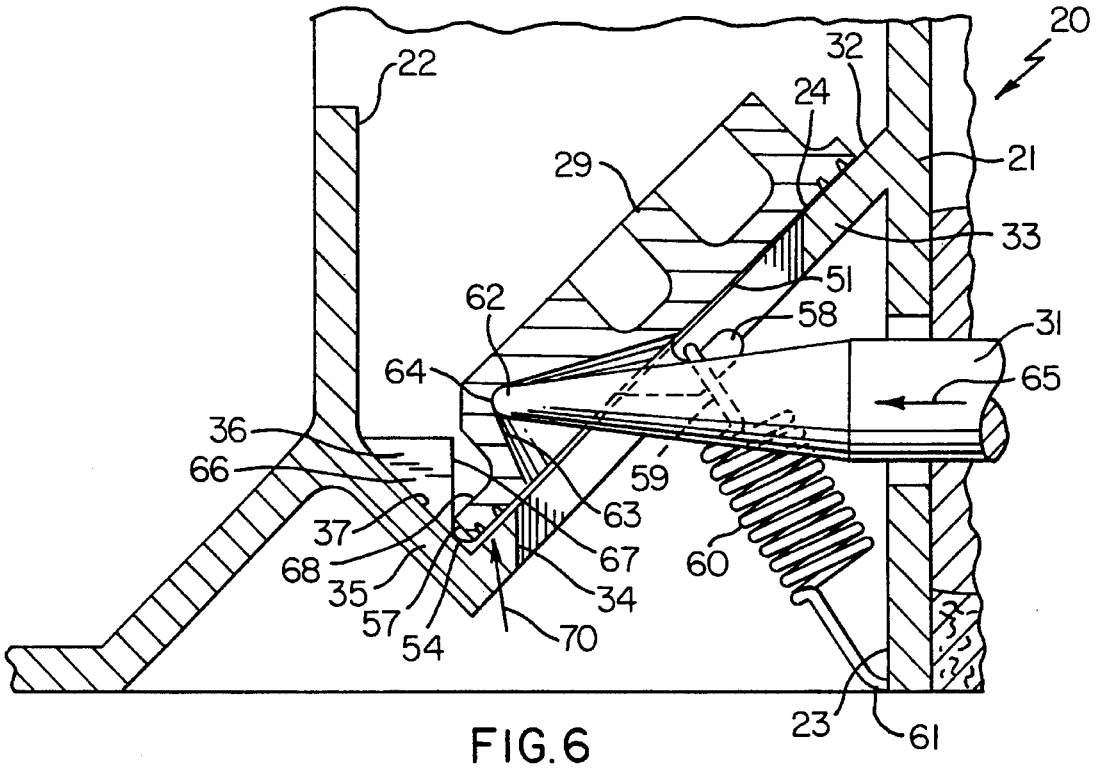
FIG. 6 is a view similar to FIG. 5 and illustrates the control device initially breaking loose the valve member when the same had been initially frozen to the valve seat means in its closed position.
Figure 7:
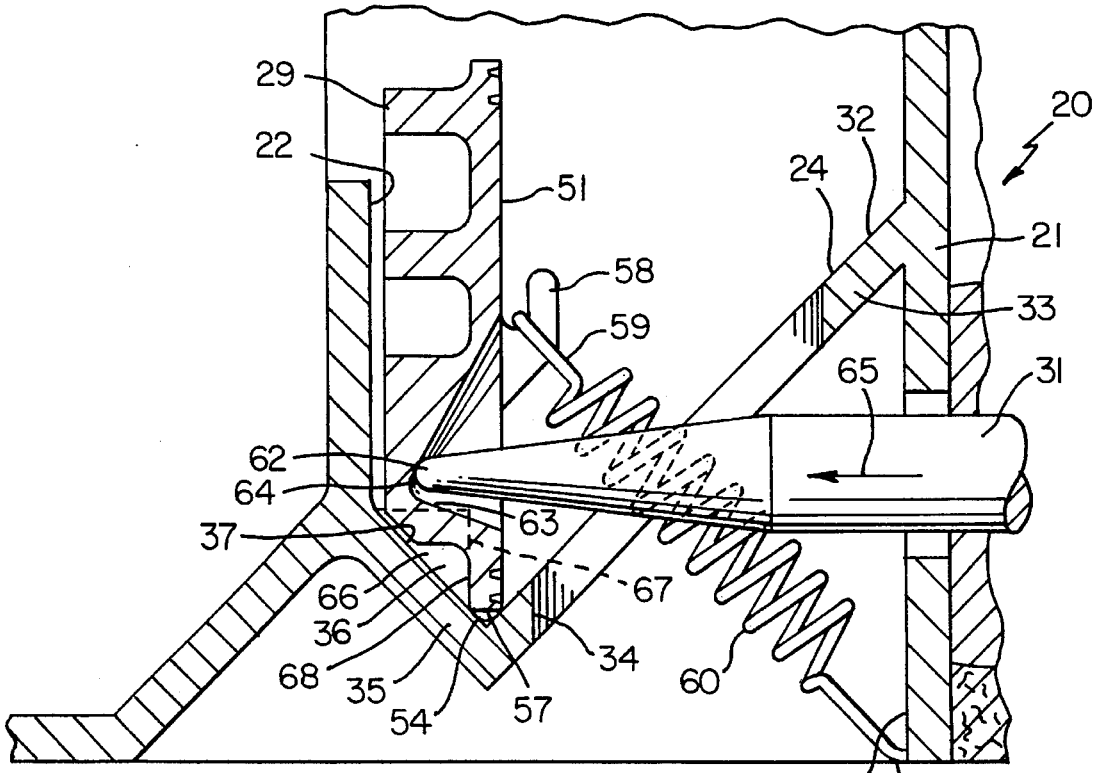
FIG. 7 is a view similar to FIG. 5 and illustrates the valve member in its fully opened position.

Referring now to FIGS. 1–7, a new control device of this invention is generally indicated by the reference numeral 20 and comprises a housing means 21 having an inlet means 22 and an outlet means 23 interconnected together by a valve seat means 24 of the housing means 21, the control device 20 of this invention being illustrated in FIG. 1 as being disposed in a refrigerator system of this invention that is generally indicated by the reference numeral 25 and comprising a frozen food compartment 26 that is interconnected to the inlet means 22 of the housing means 21 and a nonfrozen food compartment 27 that is interconnected to the outlet means 23 whereby a structure 28 of a refrigerator (not shown) utilizing the system 25 is adapted to circulate air from the frozen food compartment 26 to the nonfrozen food compartment 27 when a movable valve member 29 of the control device 20 is moved to an open position relative to the valve seat means 24 as illustrated in FIGS. 4 and 7 by an actuator means of the control device 20 that is generally indicated by the reference numeral 30 and comprises a movable plunger pin 31 operated in a manner well known in the art. For example, see the aforementioned Orner et al, U.S. Pat. No. 5,144,813 as well as the Sepso, U.S. Pat. No. 4,530,216 and the Sepso et al, U.S. Pat. No. 4,819,442 whereby these three U.S. patents are being incorporated into this disclosure by this reference thereto whereby a further description of the details of and the reasons for a refrigerator control device as well as the operation thereof in a refrigerator system need not be further set forth.

The valve seat means 24 comprises a substantially flat surface 32 of a wall 33 of the housing means 21 and surrounds a substantially rectangular opening 34 formed through the wall 33 to interconnect the inlet 22 to the outlet 23 when the valve member 29 is disposed in an open position.

The wall 33 of the housing 21 joins with another wall 35 of the housing means 21 and cooperates with a substantially flat surface 36 of the wall 35 to define a substantially straight angled edge means 37 of the housing means 21 that extends parallel to and spaced from an edge 38 of the opening 34 throughout the length of the angled edge means 37 which has opposed end means 39 and 40 that respectively terminate at upstanding walls 41 and 42 of the housing means 21 and cooperate therewith to define the inlet means 22 previously set forth.

The valve member 29 comprises a generally rectangular configuration defined by opposed end edge means 43 and 44 which respectively are joined at the opposed end means 45, 46 and 47, 48 with a pair of opposed side edge means 49 and 50, the valve member 29 having a substantially flat side 51 that engages the valve seat means 24 to seal closed against the same around the opening 38 by having a peripheral portion 52 of the surface 51 of the valve member 29 engaging the surface 32 of the wall 33 as illustrated in FIGS. 1 and 5.

The opposed end means 45 and 46 of the end edge means 43 of the valve member 29 comprises a pair of unique and like pivot parts 53 disposed in spaced apart relation and being the only parts of the end edge means 43 that engage the angled edge means 37 of the housing means 21 to pivot thereon in a manner hereinafter set forth.

Each pivot part 53 of the valve member 29 has a longitudinally disposed exterior surface 54 which is arcuate throughout the longitudinal length thereof and, in one working embodiment of the control device 20 of this invention, is semicircular in cross section and extends both inboard and outboard of its respective side edge means 49 or 50 of the valve member 29. Each pivot part 53 has a gusset-like section 55 that joins with its respective side edge means 49 or 50 to provide reinforcement for the respective pivot part 53, the respective pivot part 53 having a substantially flat end surface 56 for being engagable with its respective side wall 41 or 42 of the housing means 21 so as to space its respective side edge 49 or 50 from the respective side wall means 41 or 42 to ensure that the sides 49 and 50 of the valve member 29 do not drag on the side walls 41 and 42 during the opening and closing movement of the valve member 29.

The end edge means 43 of the valve member 29 between the pivot parts 53 comprises a substantially straight part 57 that is spaced from the angled edge means 37 of the housing means 21 in all pivotal positions of the valve member 29 relative thereto as will be apparent hereinafter so as to ensure that only the pivot parts 53 have the rounded surfaces 54 thereof in engagement with the angled edge means 37 to not only provide a smooth operating motion for the valve member 29, but also to provide a more stable two-point contact with the housing means 21 to reduce rocking of the valve member as provided by the substantially straight edge means of the prior known control device.

As in the prior known control device, the surface 51 of the valve member 29 is provided with a hook or projection 58 around which one end 59 of a tension spring 60 is hooked with its other end 61 being fastened to the housing means 21 so that the normal force of the tension spring 60 is to pull the valve member 29 to its closed position against the valve seat means 24 in the manner illustrated in FIGS. 1 and 5. However, the plunger 31 of the actuator means 30 has its end 62 disposed within a recess 63 formed in the side 51 of the valve member 29 to engage against a surface 64 thereof so that when the actuator pin 31 is axially moved in the direction of the arrow 65 in FIG. 7, by the actuator means 30, the valve member 29 pivots on its pivot parts 53 in opposition to the force of the tension spring 60 and moves to its fully opened position as illustrated in FIG. 7. Of course, when the actuator pin 31 is permitted to move axially to the right in FIG. 7 by the actuator 30, the force of the tension spring 60 causes the valve member 29 to pivot in a clockwise direction as illustrated in the drawings so as to close against the valve seat means 24 all in a manner well known in the art.

As in such prior known control devices, the walls 41 and 42 of the housing means 21 respectively carry a pair of like stops 66 having flat end surfaces 67 against which the end edge means of the valve member is to engage if the valve member is initially frozen to the valve seat means and the actuator means is tending to open that valve member.

For example, it can be seen in FIG. 6 that the surface 67 of the stops 66 are so positioned relative to the valve means 29 that an upper surface 68 of the end edge means 43 of the valve member 29 is normally spaced therefrom when the valve member 29 is in its closed position, such spacing being located in the general area of the arrow 69 of FIG. 5. During a normal opening of the valve member 29 without a frozen condition, the valve member 29 pivots on the rounded surfaces 54 of the pivot parts 53 of the valve member 29 as illustrated in FIG. 7.

However, when the valve member 29 is frozen in its closed condition, the force 65 of the actuator pin 31 initially moving in the direction illustrated in FIG. 6 causes the valve member 29 to break loose from the valve seat means 24 in the area of the arrow 70 in FIG. 6 to engage against the stops 67 and then pivot so as to break loose from the remaining portion of the valve seat means 24 whereby the valve member 29 is then permitted to pivot to the fully open position in the manner illustrated in FIG. 7.

Therefore, it can be seen that the pivot parts 53 of the valve member 29 of this invention readily permit the valve member 29 to pivot from its closed position to its open position as well as from its open position to its closed position as the arcuate surfaces 54 rock or roll on the angled edge means 37 of the housing means 21 with the remaining part 57 of the end edge means 43 of the valve member 29 being completely spaced from the end edge means 37 so that a two-point contact is provided by the pivot parts 53 for a more stable two-point contact operation so that the valve member 29 of this invention operates with a smoother motion than when the end edge means of the valve member is a substantially straight flat surface that tends to engage against the angled edge means 37 throughout the entire length thereof as in the prior known device.

While the control device 20 of this invention can be formed of any suitable material, in one working embodiment of the control device 20, the housing means 21 is formed of polystyrene and the valve member 29 is formed of 144R LEXAN which is a plastic material sold by the DuPont Corporation of Wilmington, Del. The valve member 29 in such working embodiment is approximately 3.301 inches between the side edge means 49 and 50 thereof and is approximately 1.183 inches between the apexes of the surfaces 54 of the pivot parts 53 and the end edge means 47 with the part 57 of the end edge means 53 being inwardly offset approximately 0.015 of an inch. The arcuate surfaces 54 are defined by a full radius with the arcuate surfaces 54 each being approximately 0.062 of an inch thick at the full diameter thereof. The length of each arcuate surface 54 is approximately 0.150 of an inch and the end surface 56 thereof extends beyond the respective end edge means 49 or 50 approximately 0.070 of an inch.

Therefore, it can be seen that this invention not only provides a new control device and a new refrigeration system utilizing such a control device, but also this invention provides a new method of making such a control device and a new method of making such a refrigerator system.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device for a refrigerator system having a frozen food compartment and a nonfrozen food compartment interconnected together by an air circulating means that is adapted to direct an air flow from said frozen food compartment to said nonfrozen food compartment when a valve member of said control device is in an open condition thereof, said control device comprising a housing means having a valve seat means and having an inlet means for interconnecting to said frozen food compartment and an outlet means for interconnecting to said nonfrozen food compartment, said valve seat means interconnecting said inlet means and said outlet means together, a movable valve member carried by said housing means and being adapted to open and close said valve seat means by being respectively moved to an open position thereof and a closed position thereof, and actuator means carried by said housing means and being operatively interconnected to said valve member to move said valve member between said positions thereof, said housing means having a substantially straight angled edge means, said valve member having an end edge means that is adapted to pivot on said angled edge means, said end edge means having opposite end means thereof, the improvement wherein said end edge means of said valve member comprises a pair of pivot parts respectively disposed at said opposite end means thereof in spaced apart relation and being the only parts of said end edge means that engage said angled edge means of said housing means to pivot thereon, said valve member having opposite spaced apart and parallel side edge means respectively disposed substantially perpendicular to said end edge means thereof, said pivot parts of said valve member respectively extending outboard of their respective side edge means.

2. A control device as set forth in claim 1 wherein each said pivot part has a flat free end whereby said flat free ends of said pivot parts are spaced apart and parallel to each other while being respectively disposed outboard of said side edge means and parallel thereto.

3. A control device as set forth in claim 1 wherein each said pivot part has a longitudinally disposed exterior surface that is arcuate in transverse cross section throughout the longitudinal length thereof.

4. A control device as set forth in claim 1 wherein each said pivot part has a gusset-like section thereof extending along its respective side edge means to reinforce that said pivot part.

5. A control device as set forth in claim 1 wherein said end edge means of said valve member between said pivot parts is substantially straight and spaced from said angled edge means of said housing means in all operating positions of said valve member.

6. In a refrigerator system having a frozen food compartment and a nonfrozen food compartment interconnected together by an air circulating means that has a control device therein for controlling the opening of said air circulating means between said compartments, said control device comprising a housing means having a valve seat means and having an inlet means interconnecting to said frozen food compartment and an outlet means interconnecting to said nonfrozen food compartment, said valve seat means interconnecting said inlet means and said outlet means together, a movable valve member carried by said housing means and being adapted to open and close said valve seat means by being respectively moved to an open position thereof and a closed position thereof, and actuator means carried by said housing means and being operatively interconnected to said valve member to move said valve member between said positions thereof, said housing means having a substantially straight angled edge means, said valve member having an end edge means that is adapted to pivot on said angled edge means, said end edge means having opposite end means thereof, the improvement wherein said end edge means of said valve member comprises a pair of pivot parts respectively disposed at said opposite end means thereof in spaced apart relation and being the only parts of said end edge means that engage said angled edge means of said housing means to pivot thereon, said valve member having opposite spaced apart and parallel side edge means respectively disposed substantially perpendicular to said end edge means thereof, said pivot parts of said valve member respectively extending outboard of their respective side edge means.

7. A system as set forth in claim 6 wherein each said pivot part has a flat free end whereby said flat free ends of said pivot parts are spaced apart and parallel to each other while being respectively disposed outboard of said side edge means and parallel thereto.

8. A system as set forth in claim 6 wherein each said pivot part has a longitudinally disposed exterior surface that is arcuate in transverse cross section throughout the longitudinal length thereof.

9. A system as set forth in claim 6 wherein each said pivot part has a gusset-like section thereof extending along its respective side edge means to reinforce that said pivot part.

10. A system as set forth in claim 6 wherein said end edge means of said valve member between said pivot parts is substantially straight and spaced from said angled edge means of said housing means in all operating positions of said valve member.

* * * * *